US006010610A

United States Patent [19]

Yih

[11] Patent Number: 6,010,610

[45] Date of Patent: Jan. 4, 2000

[54] METHOD FOR ELECTROPLATING METAL COATING(S) PARTICULATES AT HIGH COATING SPEED WITH HIGH CURRENT DENSITY

[76] Inventor: Pay Yih, 11907 Madison Ave., Lakewood, Ohio 44107-5026

[21] Appl. No.: 09/018,553

[22] Filed: Feb. 4, 1998

Related U.S. Application Data

[63] Continuation-in-part of application No. 08/837,299, Apr. 11, 1997, which is a continuation-in-part of application No. 08/796,204, Feb. 7, 1997, abandoned

[60] Provisional application No. 60/041,635, Apr. 9, 1996.

[51] Int. Cl.[7] ..... C25D 7/00

[52] U.S. Cl. ..... 205/149

[58] Field of Search ..... 205/144, 145, 205/149

[56] References Cited

U.S. PATENT DOCUMENTS 4,908,106 3/1990 Takeshima et al. ..... 204/23

FOREIGN PATENT DOCUMENTS 59-41489 3/1984 Japan .

59-89788 5/1984 Japan .

*Primary Examiner*—Kathryn Gorgos
*Assistant Examiner*—Edna Wong
*Attorney, Agent, or Firm*—Michael N. Meller; Eugene Lieberstein

[57] ABSTRACT

The electroplating process of the present invention is a cyclical operation having at least three essentially independent steps in each cycle of operation with the independent steps carried out in sequence and consisting of stirring, sedimentation and electroplating. The sedimentation step occurs over an essentially quiescent time interval with essentially no current flow through the electrolyte and essentially no stirring so as to form a sedimentation layer of loosely contacted particulates on said cathode plate. The electroplating step follows the sedimentation step at a current density of over at least 5 A/dm$^2$. The stirring step immediately follows the step of electroplating with the stirring operation being sufficiently vigorous to disperse the particulates in the sedimentation layer and to break up particulates bridged by metallic coating formed during the previous step of electroplating.

10 Claims, 4 Drawing Sheets

FIG. 1a
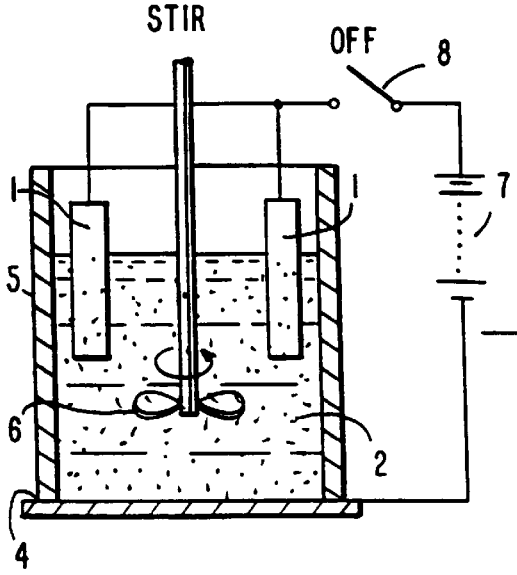
FIG. 1b
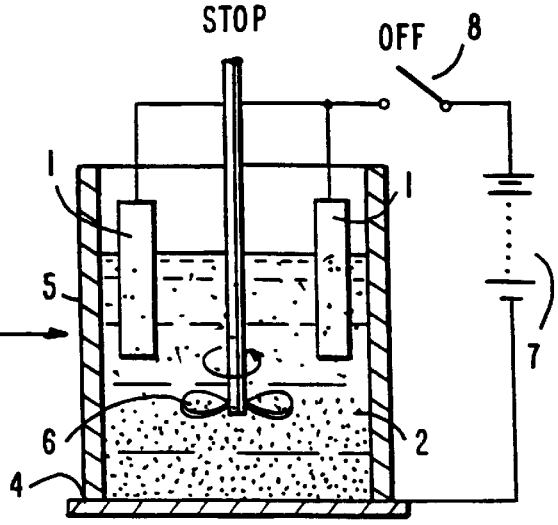
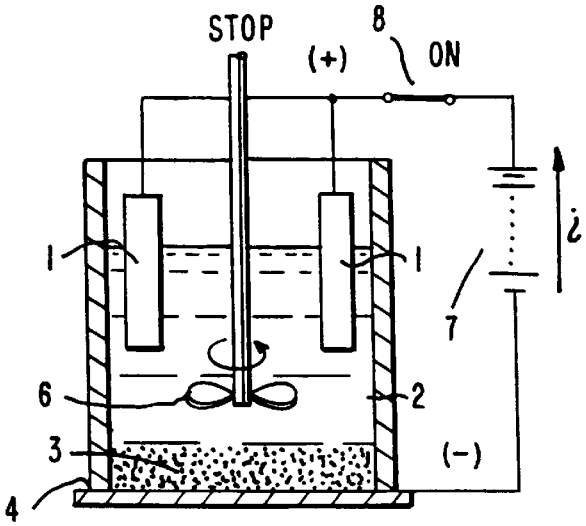
FIG. 1c

FIG. 2
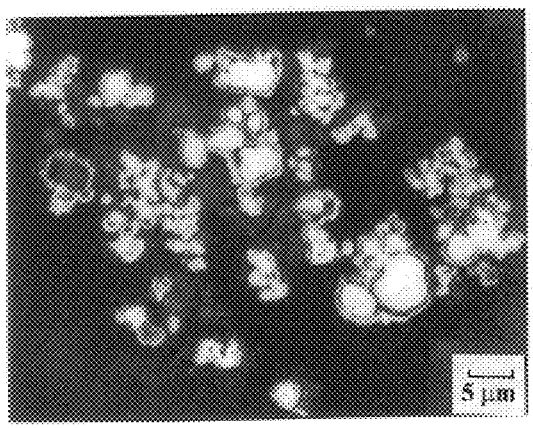
FIG. 3
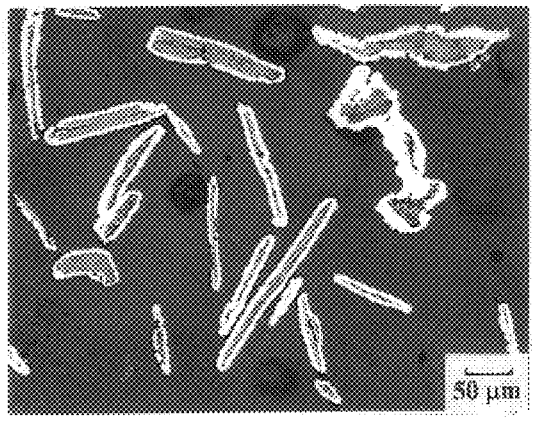
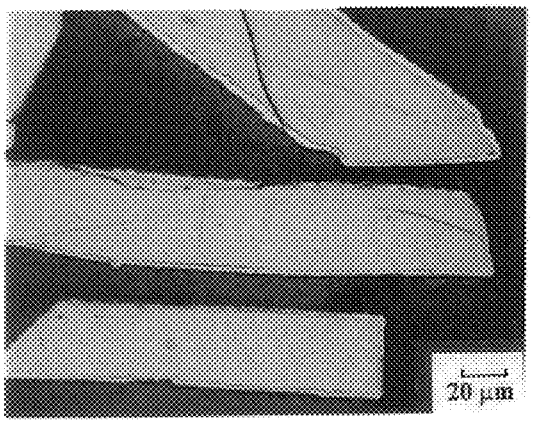
FIG. 4
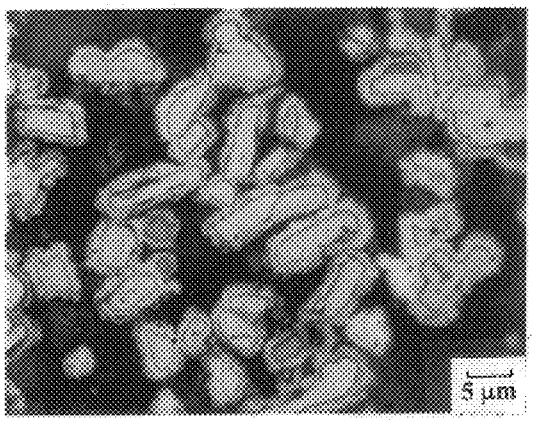
FIG. 5

FIG. 6
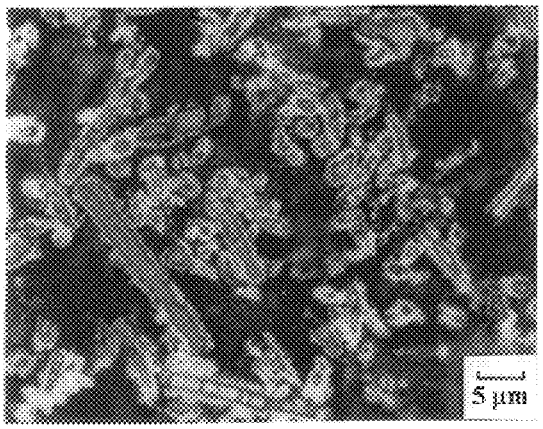
FIG. 7
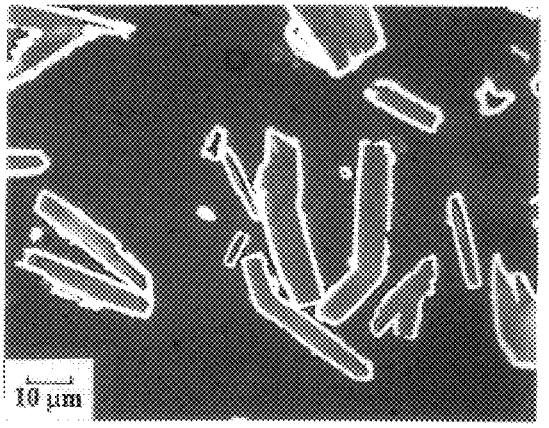
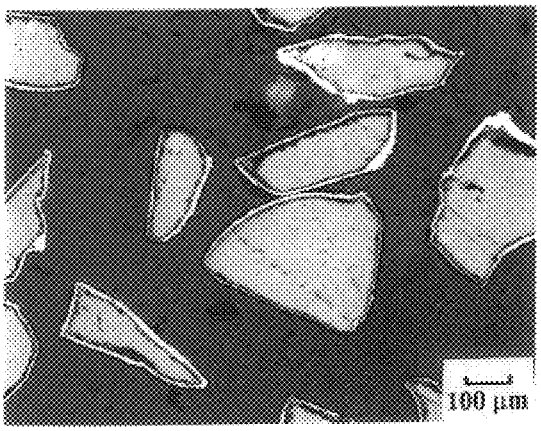
FIG. 8
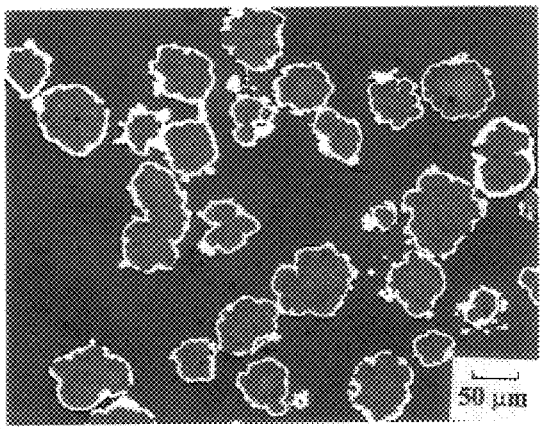
FIG. 9

METHOD FOR ELECTROPLATING METAL COATING(S) PARTICULATES AT HIGH COATING SPEED WITH HIGH CURRENT DENSITY

This application is a continuation-in-part of U.S. application Ser. No. 08/837,299, filed Apr. 11, 1997, now pending, which is a continuation-in-part of U.S. application Ser. No. 08/796,204, filed Feb. 7, 1997, now abandoned, which claims the benefit of U.S. Provisional Application Ser. No. 60/041,635, filed Apr. 9, 1996.

FIELD OF THE INVENTION

This invention relates to a method for electroplating a metal coating on particulates substantially independent of the size of the particulates and at high coating speed.

BACKGROUND OF THE INVENTION

The term "particulates" for purposes of the present invention include individual or equiaxed particles, platelets, flakes, whiskers and short or chopped fibers. It is common to use particulates as additives, reinforcements and functional elements in plastics, rubbers, metals, metal alloys, ceramics and other materials to form composites having improved properties.

The characteristics and surface properties of composite particulates can be further enhanced to improve their resistance to corrosion, moisture and/or heat etc. by coating the composite particulates with a metallic composition. The coating can also be used to provide enhanced surface characteristics and surface texture. This represents yet another generation of composite particulates which have many important applications in different areas of technology.

There are numerous conventional coating processes available to coat metal upon particulates including electroplating, which is also commonly referred to as electrodeposition, chemical vapor deposition (CVD), physical vapor deposition (PVD) and autocatalytic (electroless) plating. Electroplating is preferred as being more versatile in the selection of metal to be coated, high coating efficiency relative to the other processes, control over coating thickness and cost. Nevertheless, at present, the electroplating process has limited commercial application for reasons related primarily to its inability to uniformly coat particulates of wide varying sizes and the coating speed to form a coating of given thickness is low. In fact, at present, the electroplating process typically requires a total electroplating time of about 100 hours or more to coat an average thickness of 1.0 $\mu$m. For many commercial applications this is unacceptable.

Electroplating metal coating onto the surface of particulates is taught in U.S. Pat. No. 4908106. This patent is limited to particulates having a small size i.e. "fine" particulates in a size range varying from 0.1 to 10 $\mu$m and at low current density of between 2A/dm$^2$ to 5 A/dm$^2$ of the cathode plate. For consistency all reference hereafter to current density for purposes of this patent application relates to a measurement of current in amperes per surface area (dm$^2$) of cathode plate. Heretofore electroplating was carried out at current densities below about 5A/dm$^2$ and required a very long electroplating time to coat a given amount of metal on the particulates.

Electroplating of metal coatings on particulates is also taught in Japanese Patent No's: JP-A-59-41489 and JP-A59-89788 respectively. Both of these Japanese patents teach an electroplating process which requires the particles to be suspended in an electrolyte solution which is continuously agitated while performing the electroplating operation. The electroplating operation is conducted at low current density in the range of 0.4 A/dm$^2$~1.7 A/dm$^2$ which was calculated based upon its teaching of current per gram particulates, particulate loading and diameter of the cathode plate. Although the current amperage through the electrolyte can be intentionally increased, if this were done in the arrangement taught in these Japanese patents only part of the current available can reduce the metallic ions on the particles whereas the rest of the current would be wasted on the generation of hydrogen and the heating of the electrolyte solution. Operation at low current density results in low coating speed i.e. it requires a longer total electroplating time to deposit a given volume of metal or a given average coating thickness.

In many applications, such as metal-matrix composites and thermal spray powder, sufficient coating thickness (> at least 0.5 $\mu$m) is needed and typically well over 1.0 $\mu$m. Because of the large specific surface area of the particulates even thin coatings require a deposit of a relatively large amount of metal. If a low plating current density below 5 A/dm$^2$ is used as taught in the prior art the coating rate or speed will be comparatively low requiring long electroplating times involving many days of electroplating which is not cost effective for large volume applications.

SUMMARY OF THE INVENTION

It has been discovered in accordance with the present invention that the coating rate can be substantially increased i.e. the electroplating processing speed can be raised substantially at a current density of above 5 A/dm$^2$ and in fact in a range of 15 A/dm$^2$ to 25 A/dm$^2$ or higher provided the electroplating process is carried out cyclically with each cycle of operation having three independent steps with the step of electroplating separated from two additional independent steps of sedimentation and stirring (agitation) and with the three steps carried out in proper sequence relative to one another. The essential independence of each step in the process relative to the other steps is critical to the invention and its benefit is unexpected. Moreover it is also critical that the agitation step which follows the step of electroplating be sufficiently vigorous to disperse the sedimented particulates formed during the sedimentation step. The sedimentation step should occur essentially free of any electrolyte agitation and without essentially any current flow through the electrolyte solution so that the sedimentation step occurs during a quiescent interval to allow a sedimentation layer to form on the cathode plate with the particulates in physical and electrical contact with one another. By maintaining good electrical contact between the individual particulates in the sedimentation layer a cathode plate current density can be realized in a range of from above 5 A/dm$^2$ up to 25 A/dm$^2$ or higher.

Broadly, the method of electroplating particulates in a metallic ion- containing electrolyte solution within an electroplating device having an anode and a cathode plate in accordance with the present invention comprises a cyclical operation having at least three essentially independent steps in each cycle of operation with each step carried out in a given sequence consisting of stirring, sedimentation and electroplating with the sedimentation step occurring over an essentially quiescent time interval with essentially no current flow through the electrolyte and essentially no agitation so as to form a sedimentation layer of loosely contacted particulates on said cathode plate, applying an electromotive potential across said anode and cathode plate to create an electric current in said electrolyte for performing said electroplating step at a current density of over 5 A/dm$^2$ at the cathode plate and performing the stirring step immediately following the step of electroplating with the stirring operation being sufficiently vigorous to disperse the particulates in the sedimentation layer and to break up particulates bridged by metallic coating formed during the step of electroplating.

BRIEF DESCRIPTION OF THE DRAWINGS

FIG. 1 schematically represents the apparatus for carrying out the electroplating process of the present invention;

FIG. 2 shows an optical micrograph of a polished section of copper coated molybdenum particles;

FIG. 3 shows an optical micrograph of a polished section of iron coated graphite flakes;

FIG. 4 shows an optical micrograph of a polished section of zinc coated Nd—Fe—B ribbon flakes;

FIG. 5 shows an optical micrograph of a polished section of copper coated titanium-diboride platelets;

FIG. 6 shows an optical micrograph of a polished section of copper coated silicon-carbide whiskers;

FIG. 7 shows an optical micrograph of a polished section of nickel coated boron-nitride flakes;

FIG. 8 shows an optical micrograph of a polished section of nickel coated silicon-carbide particles;

FIG. 9 shows an optical micrograph of a polished section of nickel coated aromatic polyester particles.

DETAILED DESCRIPTION OF THE PREFERRED EMBODIMENTS

Figure 10:
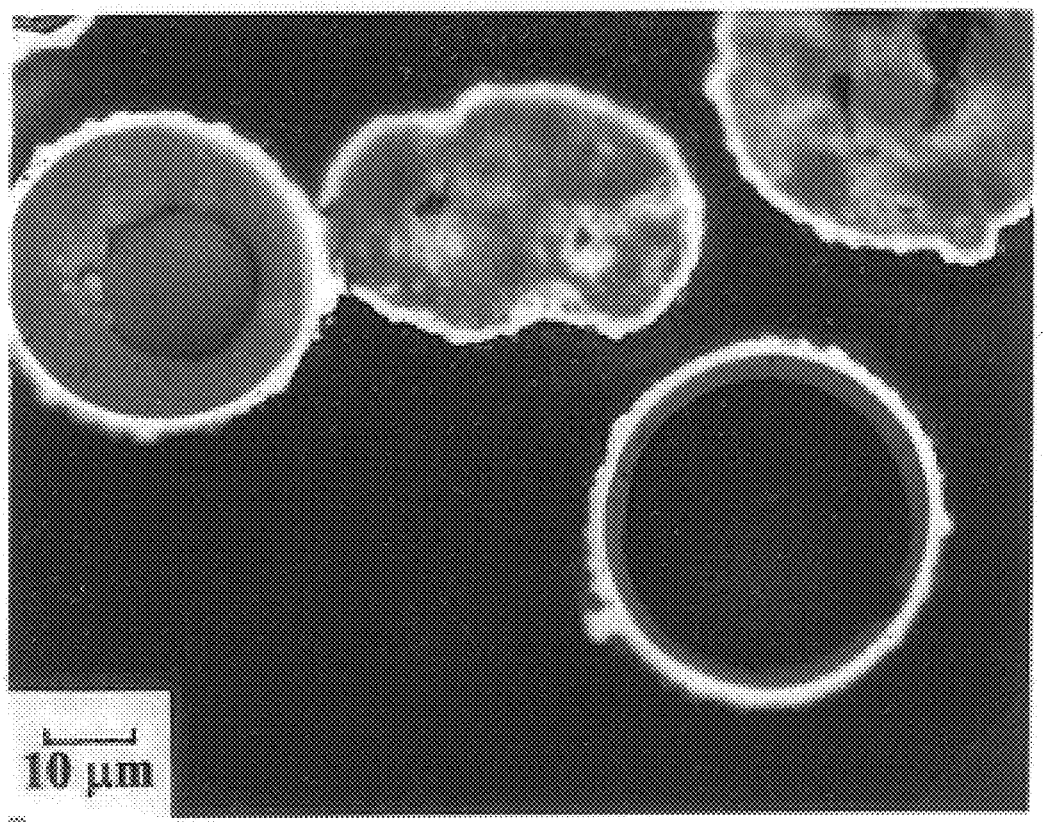
FIG. 10 shows an optical micrograph of a polished section of nickel coated yttria stabilized zirconia hollow spheres.

For electrically conductive particulates, such as metal or alloy, intermetallic compound and graphite, the method of the present invention can be used to electroplate a desired metal coating directly over the surface of the particulates. However, if the particulates are electrically non-conductive, such as ceramic and polymer, the particulates should first be metallized. Any conventional method or technology, such as CVD or electroless plating may be used for the purpose of making the surface of the non-conductive particulates electrically conductive. After the surface of the particulates are metallized the method of the present invention is then applied to obtain the desired metal coating and coating thickness.

The present invention utilizes the basic operating principles of a conventional electroplating process which is carried out in an electroplating bath containing a metallic ion-containing electrolyte, an anode and a cathode. In a conventional electroplating operation a positive potential is applied to the anode and a negative potential is applied to the cathode with the potential difference functioning as the driving force for metal ions to move from the anode to the cathode.

In accordance with the present invention the particulates to be electroplated are immersed in the electrolyte solution and permitted to collect by gravity on the cathode plate so as to form a sedimentation layer as an independent step in the electroplating process. The particulates in the sedimentation layer although loosely connected together make a good electrical connection to the negative pole of the DC power supply through the cathode electrode which for purposes of the present invention is hereafter called the "electrical connection effect" of the present invention. This "electrical connection effect" permits current reduction and deposition of the metal ions directly on the particulates in the sedimentation layer. In this fashion the cathode actually serves as an electrical connector between the negative pole of the DC power supply and the particulates to be electroplated. In other words, only those particulates that have good electrical connection with the cathode can be effectively deposited with metal. Moreover the sedimentation layer minimizes any direct metal deposition on the cathode electrode.

According to Faraday's law of electrolysis, the relation among the weight of electrodeposited metal, current and time can be expressed by the following equation:

$$m=\kappa It \tag{1}$$

where m is the weight of electrodeposited metal (gram), κ is the electrochemical equivalent of the metal (g/(A.hr)), I is the current strength (ampere) and t is the plating time (hour).

Equation (1) indicates that, for a given amount of electrodeposited metal, the higher the current, the less plating time is needed. In actual electroplating, the amount of metal coating obtained is usually less than that calculated from Equation (1), since the current efficiency is usually less than 100%. Part of the current will be wasted on the generation of hydrogen gas and heat.

Current density in the plating process of the present invention relates to the reducing current per cathode plate area. As earlier indicated conventional electroplating is typically practiced with a current density in the range of 0.5 A/dm$^2$~5 A/dm$^2$. In accordance with the present invention since particulates have a large surface area and are connected electrically to the cathode plate by means of the "electrical connection effect" they serve as cathodes and permit a much higher cathode plate current density to be attainable than in conventional electroplating.

Other factors controlling the deposition of metal ions in accordance with the present invention is based upon what is hereafter referred to as "the negative potential effect" and the "shielding effect" of the present invention respectively. In accordance with "the negative potential effect" metal ions will preferentially deposit on a cathode site where the potential is more negative whereas the "shielding effect" is based upon the principle that if the electrolyte bath contains multiple cathodes the metal ions will preferentially deposit on the cathodes physically closest to the anode. Accordingly, since the particulates in the sedimentation layer serve as cathodes by means of the "electrical connection effect" then the cathodes positioned closest to the anode or "front cathodes" will shield the cathodes further back or "back cathodes" from metal deposition. The combination of these effects explain the effectiveness of the present invention.

The preferred embodiment of the present invention is illustrated in FIG. 1, which schematically describes 1 (one) full cycle in the process of the present invention inclusive of a minimum of three separate steps consisting of stirring—sedimentation—and electroplating. These three steps, viz., stirring—sedimentation—and electroplating must be carried out essentially independent of one another and in the sequence indicated. The combined steps of stirring—sedimentation—and electroplating constitute one full cycle of the process of the present invention and is preferably repeated over multiple cycles.

The electroplating apparatus for electroplating the particulates 3 with a metal coating is of itself conventional. An electrolyte solution 2 is placed in a housing or container 5 which also includes one or more anode(s) 1 and at least one cathode electrode 4. The cathode 4 is, in general, located at the bottom of the container 5 relative to the position of the anode 1. The particulates 3 to be electroplated are immersed into the electrolyte 2 and a DC power supply 7 is connected across the anode 1 and cathode 4. The DC power supply 7 can supply a voltage of fixed magnitude or a voltage of varying magnitude with an output configuration such as a square wave or other pulse type waveform which may even be a sinusoidal waveform.

The anode 1 can be composed of the same material as the metal for coating the particulates 3, or a non-dissolvable conductive material, such as graphite, and can be any shape. The cathode 4 can be of any conductive material and can be of any shape although for purposes of the present invention will be referred to simply as the "cathode plate". The cathode plate 4 should preferably have a uniform flat surface separated a fixed distance from the anode 1 and should preferably be composed of titanium or aluminum which have a natural oxide film that can prevent unnecessary metal deposition.

In the stirring step of the present invention as shown in FIG. 11(*a*), the particulates 3 are vigorously stirred by stirrer 6, without current passing through the electrolyte solution 2. This can be accomplished simply by switching the electrical switch 8 of the power supply 7 to its "off" position. Alternatively, if the power supply output is a pulse waveform i.e., is intermittent the stirring (agitation) step and the sedimentation step must be carried out during the interval when current is not being supplied or less preferably during the interval when the cathode is of reverse polarity i.e., is rendered positive relative to the anode. The latter case can occur only when the power supply output has a configuration which varies above and below a zero output. However, in the preferred operation the power supply will either have an interval of zero output or will generate an output voltage of fixed magnitude. In either case the steps of stirring and sedimentation will occur during the interval of zero or essentially zero current.

The sedimentation step follows the stirring step as is shown in FIG. 1(*b*). The sedimentation step is independent of the stirring step which should be completely stopped to let particulates 3 sedimentate to cathode plate 4 by gravity to form a particulate sedimentation layer without any current flow from the power supply 7. The step of electroplating follows the sedimentation step as shown in FIG. 1(*c*). The power supply should provide driving current for coating the particulates only during the electroplating step i.e., with the electrical switch 8 in the "on" position. During this step a positive potential is applied by the power supply 7 to the anode(s) 1 and a negative potential to the cathode plate 4 which permits a reducing current to flow though the anode (s) 1, the particulates 3 in the sedimentation layer and the cathode plate 4 for depositing metal on the particulates 3 in the sedimentation layer. Each cycle of the process may be repeated to obtain a desired metal coating thickness or to coat a specified amount of metal.

In the stirring step shown in FIG. 1(*a*), the particulates 3 were vigorously stirred at least at the outset following the step of electroplating to cause the particulates 3 in the sedimentation layer to disperse within the electrolyte solution 2 and to break up any particulates which may have become bridged during the electroplating step. By repeating each cycle of operation, the vigorous stirring will break any possible coating bridge among the particulates that may happen in the electroplating step in the previous cycle and also causes a random relocation of the particulates in the sedimentation layer of the next cycle to ensure uniform coating of all of the particulates. The stirring step also can eliminate any non-uniform metal ion concentration in the electrolyte 2 that may be caused by high speed metal deposition in a previous electroplating step. The stirring speed depends on many factors, which may include particle size, density, shape and the shape and size of stirrer. In this invention, a three-blade propeller was used and the stirring speed was in the range of 50~500 rpm. For heavy and large particulates, a higher stirring speed is suitable. For light and fine particulates, a lower stirring speed is suitable. The determination of stirring time was based on the consideration of both time efficiency and the accomplishment of the purpose of stirring step mentioned above. In this invention, the stirring time was in the range of 5~20 seconds.

In the sedimentation step as shown in FIG. 1(*b*), the stirring operation is entirely or essentially stopped to let the particulates sedimentate by gravity to the cathode plate 4. The purpose of this step is to form a uniform particulate sedimentation layer on the cathode 4 of controlled thickness. By doing so, the particulates 3 in the sedimentation layer will have good electrical connection with one other, as well as good electrical contact with the cathode plate 4. Also, the sedimentation layer will form sufficient interstices between particulates 3 to provide adequate "channel(s)" for electrolyte passage. The time interval of the sedimentation step is determined by many factors, which includes particulate density, size and shape. In this invention, a sedimentation time interval in the range of 15~150 seconds was used. For time efficiency, an unnecessarily excessive long sedimentation time interval should be avoided. The sedimentation time interval should be determined such that most particulates (about 85~90%) can sedimentate to the cathode plate 4 in any one cycle of operation. Successive cycles of operation will assure all of the particulates to sedimentate on the cathode plate and will assure a uniform metal coating on all of the particulates. In general, particulates having high density, large size and small aspect ratio (defined as ratio of length to diameter for particulates such as short or chopped fibers and whiskers, or ratio of long axis to thickness for particulates such as flakes and platelets) will only need a short sedimentation time interval. The aspect ratio for equiaxed particles is usually considered as 1. The particulates having low density, small size and large aspect ratio may need a longer sedimentation time interval.

In the electroplating step, a reducing current is caused to pass through anode(s) 1, the sedimentation layer of particulates 3 and the cathode plate 4 by switching on the DC power supply 7. Since the particulates in the sedimentation layer physically contact one another and are in physical contact with the cathode plate 4 the metal ions in the electrolyte will discharge and be deposited on all of the particulates 3 in the sedimentation layer. Since a large number of the particulates are involved in metal deposition at the same time, the current density of the cathode plate can be much higher than the current density conventionally achieved using the electroplating process. This also results in achieving a very high coating rate and very fast processing speed. In accordance with the present invention a suitable current density of the cathode plate in the range of 15 $A/dm^2$~25 $A/dm^2$ was easily achieved as shown the following examples. This cathode plate current density range is at least 4 times higher than that reported in the prior art and means that the processing speed of this invention is at least 4 times faster than those reported in the prior art. The current density will vary depending on the composition of the metal to be coated and on the particulates to be coated.

The electroplating step which occurs in each cycle of operation should extend over an interval of time based on time efficiency i.e., long enough to obtain a reasonble coating deposit during each cycle of operation but not too long to cause a metal coating bridge in any one cycle which is too thick to break up by agitation in the next stirring step. A suitable time selection mainly depends on the current density of cathode plate. The higher the current density, the shorter the electroplating time. In the examples of this invention, the electroplating time was in the range of 150~240 seconds, although a wider time range is readily achievable.

Based upon the electrical connection effect, to achieve current density as high as possible no stirring or agitation should occur during the step of electroplating. Moreover, the negative potential effect and the shielding effect as mentioned previously will also affect the electroplating performance. Because of the negative potential effect and the electrical contact resistance of the particulates, the metal ions prefer to deposit on the particulates closer to the cathode plate 4 where the particulate potential is more negative. Also, because of the shielding effect, the metal ions prefer to deposit on the particulates far from the cathode plate 4 where the particulates are more closer to the anode 1. Furthermore, since all particulates 3 in the sedimentation layer have good electrical connection, the potential variation on the particulates will be relatively small. Combining all these effects, a uniform metal coating deposition can proceed on all the particulates in the sedimentation layer throughout the sedimentation thickness at the same time, thus a very high current density of cathode plate can be used to achieve a very high coating rate or a very fast processing speed. The sedimentation thickness should be controlled such that neither negative potential effect nor shielding effect becomes the dominating effect. If the thickness is too thick, the shielding effect will become strong on the particulates near the cathode plate resulting in no metal deposition on these particulates. If the thickness is too thin, the negative potential effect will become strong, which results in a unnecessarily excessive metal deposition on cathode plate. The suitable sedimentation thickness depends on many factors, including particulate density, size and shape, as well as the throwing power of the electrolyte used for metal deposition. In this invention, a preferred sedimentation thickness that has been used is in the range of about 3~30 mm with a minimum thickness of at least about 1 mm. In general, a thicker sedimentation is suitable for particulates having large particle size and large aspect ratio. A thinner sedimentation thickness should be used for particulates having small particle size and small aspect ratio.

It is essential to the present invention that essentially no current pass through anode(s) 1 and cathode 4 during the stirring step. In this step only a very small amount of the particulates will have electrical contact with the cathode plate 4 as a result of random collisions. If significant current flows during this step, the negative potential effect will be the major effect and the major metal deposition will proceed on the cathode plate instead of on particulates. It would also cause a large amount of hydrogen gas and heat to generate. For the same reason, it is essential that no current should pass during the sedimentation step, in that there is an insufficient amount of particulates that have good electrical connection to the cathode plate for high current density.

In summary, each cycle of the process comprises three-steps. The number of cycles can be varied from one to as many as desired, depending on the desired coating thickness or amount of metal coating. Each of the three steps, namely the stirring step, the sedimentation step and the electroplating step is performed independent of one another and each step has its own function to ensure high quality coating at a very high coating rate or very fast processing speed. Because of all the three steps are independent it is very easy to achieve processing automation using an electronic control processor. Combined with high coating rate or high processing speed, this invention provides a method that can be used for electroplating a wide variety of particulates with various metal coatings for large volume commercial applications at low cost.

Moreover the method described in this invention is applicable to particulates of any morphology and with a particle size varying from submicron to thousands of microns. In general, all the particulates that can be wetted by aqueous solution and can sedimentate in a aqueous solution can be coated with high quality metal coating at very high coating rate or very fast processing speed by using the method described in this invention.

EXAMPLES

The following examples illustrate the utility of the present invention:

Example 1

In this example, equiaxed fine molybdenum particles having an average particle size of 2.7 $\mu$m and density of 10.22 g/cm$^3$ (supplied by Sulzer Metco Inc., Westbury, N.Y.) were directly electroplated with copper coating.

An electroplating apparatus shown in FIG. 1 was used. The wall of a tubular vessel was made of glass. Copper was used for anode plates. An aluminum cathode plate was disposed on the bottom of the vessel. A copper electroplating aqueous solution containing 60 g/liter of copper pyrophosphate, 300 g/liter of potassium pyrophosphate and 25 g/liter of ammonia citrate was charged into the electroplating apparatus. The molybdenum particles were loaded in a copper electroplating aqueous solution in the electroplating apparatus. The proportion of Mo particles to electrolyte solution per square decimeter of cathode plate was (100 gram: 1.5 liter)/dm$^2$. The molybdenum particle sedimentation thickness on the cathode plate was about 10 mm.

The parameters of the three-step process for each cycle of operation were as follows:

| | |
|---|---|
| Stirring step | |
| Stirring speed | 250 rpm |
| Stirring time | 10 seconds |
| No current passed | |
| Sedimentation step | |
| Sedimentation time | 120 seconds |
| No stirring or agitation | |
| No current passed | |
| Electroplating step | |
| Current density of cathode plate | 16 A/dm$^2$ |
| Electroplating time | 150 seconds |
| Temperature | 40~50° C. |
| No stirring or agitation | |
| Total cycle times | 70 cycles |

The amount of copper coating on molybdenum particles is 33% by weight. SEM observation showed (not shown in this invention) that the original fine molybdenum particles are agglomerated together. The optical micrograph of polished section of copper coated molybdenum particles (FIG. 2) showed that the copper coating still can penetrate into the agglomerate to cover each individual fine particle with continuous and uniform coating.

Example 2

Using the same electroplating apparatus of example 1 except for using iron as anode and titanium sheet as cathode plate, graphite flakes having an average particle size of 45 μm and density of 2.25 g/cm$^3$ (supplied by Sulzer Metco Inc., Westbury, N.Y.) were directly electroplated with iron coating.

An iron electroplating aqueous solution containing 240 g/liter of ferrous chloride and 180 g/liter of potassium chloride was used in this example. The proportion of graphite flakes to electrolyte per square decimeter of cathode plate was (20 gram: 1.5 liter)/dm$^2$.

The graphite flake sedimentation thickness on the cathode plate was about 25 mm.

The parameters of the three-step process for each cycle of operation were as follows:

| | |
|---|---|
| Stirring step | |
| Stirring speed | 150 rpm |
| Stirring time | 10 seconds |
| No current passed | |
| Sedimentation step | |
| Sedimentation time | 150 seconds |
| No stirring or agitation | |
| No current passed | |
| Electroplating step | |
| Current density of cathode plate | 16 A/dm$^2$ |
| Electroplating time | 180 seconds |
| Temperature | 30~40° C. |
| No stirring or agitation | |
| Total cycle times | 85 cycles |

The amount of iron coating on graphite flakes is 75% by weight. The optical micrograph of polished section of iron coated graphite flakes (FIG. 3) showed that each individual graphite flake was covered by continuous and uniform coating.

Example 3

Using the same electroplating apparatus of example 1 except for using zinc as anode and titanium sheet as cathode plate, Nd—Fe—B ribbon flakes having an average particle size of 200 μm and density of 7.55 g/cm$^3$ (supplied by Magnequench International, Inc., Anderson, Ind.) were directly electroplated with zinc coating.

A zinc electroplating aqueous solution containing 50 g/liter of zinc chloride, 30 g/liter of citric acid and 250 g/liter of ammonium chloride was used in this example. The proportion of Nd—Fe—B ribbon flakes to electrolyte per square decimeter of cathode plate was (180 gram: 1.5 liter)/dm$^2$.

The Nd—Fe—B flake sedimentation thickness on the cathode plate was about 20 mm.

The parameters of the three-step process for each cycle of operation were as follows:

| | |
|---|---|
| Stirring step | |
| Stirring speed | 500 rpm |
| Stirring time | 15 seconds |
| No current passed | |
| Sedimentation step | |
| Sedimentation time | 30 seconds |
| No stirring or agitation | |
| No current passed | |
| Electroplating step | |
| Current density of cathode plate | 25 A/dm$^2$ |
| Electroplating time | 120 seconds |

-continued

| | |
|---|---|
| Temperature | 15~35° C. |
| No stirring or agitation | |
| Total cycle times | 60 cycles |

The amount of zinc coating on Nd—Fe—B flakes is 23% by weight. The optical micrograph of polished section of zinc coated Nd—Fe—B flakes (FIG. 4) showed that each individual Nd—Fe—B flake was covered by continuous and uniform coating.

Example 4

Using the same electroplating apparatus and copper electroplating aqueous solution of example 1, titanium-diboride ($TiB_2$) platelets having an average particle size of 4 μm and density of 4.5 g/cm$^3$ (supplied by Advanced Ceramics Corporation, Lakewood, OH) were electroplated with copper coating.

Prior to electroplating, the surface of starting $TiB_2$ platelets were electroless plated with thin copper film. In electroless plating, the $TiB_2$ platelets were soaked in a stannous chloride aqueous solution containing 10 g/liter of stannous chloride and 40 ml/liter hydrochloric acid (37%) at ambient temperature for 10 minutes for sensitization. The sensitized platelets were then washed with water, soaked in a palladium chloride aqueous solution containing 0.5 g/liter of palladium chloride and 10 ml/liter hydrochloric acid (37%) at ambient temperature for 15 minutes for activation. The activated platelets were then washed with water. Electroless plating of activated $TiB_2$ platelets was conducted at a temperature of 55~65° C. for 10 minutes using a copper electroless aqueous solution containing 7 g/liter of copper sulfate, 34 g/liter of potassium sodium tartrate and 10 g/liter of potassium hydroxide together with 50 ml/liter of formaldehyde solution (37%) as reducing agent. The thickness of the thin copper film electroless plated on the surface of $TiB_2$ platelets was about 0.05 μm. The copper electroless plated $TiB_2$ platelets were then washed with water and ready to be electroplated with copper.

The proportion of $TiB_2$ platelets to electrolyte per square decimeter of cathode plate was (50 gram: 1.5 liter)/dm$^2$. The $TiB_2$ platelet sedimentation thickness on the cathode plate was about 20 mm.

The parameters of the three-step process for each cycle of operation were as followings:

| | |
|---|---|
| Stirring step | |
| Stirring speed | 250 rpm |
| Stirring time | 15 seconds |
| No current passed | |
| Sedimentation step | |
| Sedimentation time | 60 seconds |
| No stirring or agitation | |
| No current passed | |
| Electroplating step | |
| Current density of cathode plate | 20 A/dm$^2$ |
| Electroplating time | 150 seconds |
| Temperature | 40~50° C. |
| No stirring or agitation | |
| Total cycle times | 85 cycles |

The amount of copper coating on $TiB_2$ platelets is 60% by weight. The optical micrograph of polished section of copper coated $TiB_2$ platelets (FIG. 5) showed that each individual TiB2 platelet was covered by continuous and uniform coating.

Example 5

Using the same electroplating apparatus and copper electroplating aqueous solution of example 1, silicon-carbide (SiC) whiskers having an diameter from 0.5 μm to 1.5 μm, aspect ratio of 15 and density of 3.21 g/cm$^3$ (supplied by Advanced Refractory Technologies, Buffalo, N.Y.) were electroplated with copper coating.

Prior to electroplating, a copper electroless plating process of example 4 was used to form a thin copper film on the surface of SiC whiskers for electrical conduction. The thickness of electroless plated thin copper film was about 0.1 μm.

The proportion of SiC whiskers to electrolyte per square decimeter of cathode plate was (12 gram: 1.5 liter)/dm$^2$.

The SiC whisker sedimentation thickness on the cathode plate was about 30 mm.

The parameters of the three-step process for each cycle of operation were as follows:

| | |
|---|---|
| Stirring step | |
| Stirring speed | 200 rpm |
| Stirring time | 15 seconds |
| No current passed | |
| Sedimentation step | |
| Sedimentation time | 90 seconds |
| No stirring or agitation | |
| No current passed | |
| Electroplating step | |
| Current density of cathode plate | 16 A/dm$^2$ |
| Electroplating time | 120 seconds |
| Temperature | 40~50° C. |
| No stirring or agitation | |
| Total cycle times | 40 cycles |

The amount of copper coating on SiC whiskers is 70% by weight. The optical micrograph of polished section of copper coated SiC whiskers (FIG. 6) showed that each individual SiC whisker was covered by continuous and uniform coating.

Example 6

Using the same electroplating apparatus of example 1 except for using nickel as anode and titanium sheet as cathode plate, boron-nitride (BN) flakes having an average particle size of 45 μm and density of 2.25 g/cm$^3$ (single crystal, PT110 grade, supplied by Advanced Ceramics Corporation, Lakewood, Ohio) were electroplated with nickel coating.

Prior to electroplating, a nickel electroless plating process was used to form a thin nickel film on the surface of BN flakes for electrical conduction. The sensitization and activation treatments described in example 4 were used on BN flakes. Nickel electroless plating of activated BN flakes was conducted at a temperature of 80~90° C. for 15 minutes using a nickel electroless aqueous solution containing 30 g/liter of nickel chloride, 10 g/liter of sodium citrate, together with 10 g/liter of sodium hypophosphite as reducing agent. The thickness of electroless plated thin nickel film was about 0.1 μm.

A nickel electroplating aqueous solution containing 150 g/liter of nickel sulfate, 30 g/liter of ammonium chloride and 30 g/liter of boric acid was used in this example. The proportion of BN flakes to electrolyte per square decimeter of cathode plate was (30 gram: 1.5 liter)/dm$^2$.

The BN flakes sedimentation thickness on the cathode plate was about 20 mm.

The parameters of the three-step process for each cycle of operation were as follows:

| | |
|---|---|
| Stirring step | |
| Stirring speed | 300 rpm |
| Stirring time | 10 seconds |
| No current passed | |
| Sedimentation step | |
| Sedimentation time | 120 seconds |
| No stirring or agitation | |
| No current passed | |
| Electroplating step | |
| Current density of cathode plate | 16 A/dm$^2$ |
| Electroplating time | 120 seconds |
| Temperature | 30~40° C. |
| No stirring or agitation | |
| Total cycle times | 140 cycles |

The amount of nickel coating on BN flakes is 72% by weight. The optical micrograph of polished section of nickel coated BN flakes (FIG. 7) showed that each individual BN flake was covered by continuous and uniform coating.

Example 7

Using the same electroplating apparatus and nickel electroplating aqueous solution of example 6, silicon-carbide (SiC) particles having an average particle size of 300 μm and density of 3.21 g/Cm$^3$ (supplied by Sulzer Metco Inc., Westbury, N.Y.) were electroplated with nickel coating.

Prior to electroplating, the nickel electroless plating process of example 6 was used to form a thin nickel film on the surface of SiC particles for electrical conduction. The proportion of SiC particles to electrolyte per square decimeter of cathode plate was (150 gram: 1.5 liter)/dm$^2$.

The SiC particle sedimentation thickness on the cathode plate was about 25 mm.

The parameters of the three-step process for each cycle of operation were as follows:

| | |
|---|---|
| Stirring step | |
| Stirring speed | 450 rpm |
| Stirring time | 15 seconds |
| No current passed | |
| Sedimentation step | |
| Sedimentation time | 10 seconds |
| No stirring or agitation | |
| No current passed | |
| Electroplating step | |
| Current density of cathode plate | 20 A/dm$^2$ |
| Electroplating time | 180 seconds |
| Temperature | 30~40° C. |
| No stirring or agitation | |
| Total cycle times | 60 cycles |

The amount of nickel coating on SiC particles is 31% by weight. The optical micrograph of polished section of nickel coated SiC particles (FIG. 8) showed that each individual SiC particle was covered by continuous and uniform coating.

Example 8

Using the same electroplating apparatus and nickel electroplating aqueous solution of example 6, aromatic polyester particles having an average particle size of 75 μm and density of 1.44 g/cm$^3$ (supplied by Sulzer Metco Inc., Westbury, N.Y.) were electroplated with nickel coating.

Prior to electroplating, the nickel electroless plating process of example 6 was used to form a thin nickel film on the surface of polyester particles for electrical conduction. The proportion of polyester particles to electrolyte per square decimeter of cathode plate was (30 gram: 1.5 liter)/dm$^2$.

The polyester particle sedimentation thickness on the cathode plate was about 25 mm.

The parameters of the three-step process for each cycle of operation were as follows:

| | |
|---|---|
| Stirring step | |
| Stirring speed | 300 rpm |
| Stirring time | 10 seconds |
| No current passed | |
| Sedimentation step | |
| Sedimentation time | 90 seconds |
| No stirring or agitation | |
| No current passed | |
| Electroplating step | |
| Current density of cathode plate | 16 A/dm$^2$ |
| Electroplating time | 150 seconds |
| Temperature | 30~40° C. |
| No stirring or agitation | |
| Total cycle times | 70 cycles |

The amount of nickel coating on SiC particles is 64% by weight. The optical micrograph of polished section of nickel coated polyester particles (FIG. 9) showed that each individual aromatic polyester particle was covered by continuous and uniform coating.

Example 9

Using the same electroplating apparatus and nickel electroplating aqueous solution of example 6, yttria stabilized zirconia hollow spheres having an average particle size of 65 $\mu$m and density of 5.9 g/cm$^3$ (supplied by Sulzer Metco Inc., Westbury, N.Y.) were electroplated with nickel coating.

Prior to electroplating, the nickel electroless plating process of example 6 was used to form a thin nickel film on the surface of zirconia hollow spheres for electrical conduction. The proportion of zirconia hollow spheres to electrolyte per square decimeter of cathode plate was (120 gram: 1.5 liter)/dm$^2$.

The zirconia hollow sphere sedimentation thickness on the cathode plate was about 20 mm.

The parameters of the three-step process for each cycle of operation were as follows:

| | |
|---|---|
| Stirring step | |
| Stirring speed | 450 rpm |
| Stirring time | 15 seconds |
| No current passed | |
| Sedimentation step | |
| Sedimentation time | 50 seconds |
| No stirring or agitation | |
| No current passed | |
| Electroplating step | |
| Current density of cathode plate | 16 A/dm$^2$ |
| Electroplating time | 150 seconds |
| Temperature | 30~40° C. |
| No stirring or agitation | |
| Total cycle times | 100 cycles |

The amount of nickel coating on zirconia hollow spheres is 39% by weight. The optical micrograph of polished section of nickel coated zirconia hollow spheres (FIG. 10) showed that each individual zirconia hollow sphere was covered by continuous and uniform coating.

Example 10

Using the same electroplating apparatus and copper electroplating aqueous solution of example 1, large graphite flakes having an average particle size from 1000~5000 $\mu$m (or 1~5 mm) and density of 2.25 g/cm$^3$ (supplied by Advanced Ceramics Corporation, Lakewood, Ohio) were directly electroplated with copper coating.

The proportion of graphite flakes to electrolyte per square decimeter of cathode plate was (80 gram: 1.5 liter)/dm$^2$. The graphite flake sedimentation thickness on the cathode plate was about 30 mm.

The parameters of the three-step process for each cycle of operation were as follows:

| | |
|---|---|
| Stirring step | |
| Stirring speed | 250 rpm |
| Stirring time | 10 seconds |
| No current passed | |
| Sedimentation step | |
| Sedimentation time | 25 seconds |
| No stirring or agitation | |
| No current passed | |
| Electroplating step | |
| Current density of cathode plate | 25 A/dm$^2$ |
| Electroplating time | 150 seconds |
| Temperature | 40~50° C. |
| No stirring or agitation | |
| Total cycle times | 25 cycles |

The amount of copper coating on graphite flakes is 25% by weight. Since the particle size of graphite flakes used in this example is large, the microscopy examination is not suitable. A visual examination showed that each individual graphite flake was cover with complete, continuous and bright copper coating.

What I claim is:

1. A method of electroplating particulates in a metallic ion-containing electrolyte solution within an electroplating device having an anode and a cathode plate comprising at least one cycle of operation having at least three essentially independent steps performed separately and in sequence consisting of the steps of: stirring, sedimentation and electroplating with the sedimentation step occurring over an essentially quiescent time interval with essentially no current flow through the electrolyte and essentially no stirring so as to form a sedimentation layer of loosely contacted particulates on said cathode plate, applying an electromotive potential across said anode and cathode plate to create an electric current in said electrolyte for performing said electroplating step at a current density of over at least 5 A/dm$^2$ and performing the stirring step immediately following the step of electroplating with the stirring operation being sufficiently vigorous at least at the outset thereof to disperse the particulates in the sedimentation layer and to break up particulates bridged by metallic coating formed during the previous step of electroplating.

2. A method as defined in claim 1 comprising multiple cycles of operation with each cycle being repeated in the same sequence and having the same three steps of operation.

3. A method as defined in claim 2 wherein the current density is at least about 15 A/dm$^2$.

4. A method as defined in claim 2 wherein said electromotive potential is supplied by a power supply having an output which varies between a substantially fixed output and an output of essentially zero current with the steps of stirring and sedimentation occuring during the interval of essentially zero current output.

5. A method as defined in claim 2 wherein said electromotive potential is supplied by a power supply having a switch for turning the power supply on and off and with said power supply being switched off during the steps of stirring and sedimentation in each cycle of operation.

6. A method as defined in claim 2 wherein the stirring speed is in the range of between about 50~500 rpm.

7. A method as defined in claim 6 wherein the sedimentation step should occurs over a time interval to permit the sedimentation layer to form having a thickness of at least about 1 mm.

8. A method as defined in claim 7 wherein the sedimentation step should occurs over a time interval to permit the sedimentation layer to form having a thickness of at least about 3–30 mm.

9. A method as defined in claim 8 wherein the sedimentation step should occurs over a time interval to permit about 85~90% of the particulates to sedimentate to the cathode plate 4 in any one cycle of operation.

10. A method as defined in claim 7 wherein said particulates vary in size from submicron to thousands of microns.

* * * * *